US008118001B2

(12) United States Patent
Kowada

(10) Patent No.: US 8,118,001 B2
(45) Date of Patent: Feb. 21, 2012

(54) COOLING SYSTEM FOR AN INTERNAL COMBUSTION ENGINE IN A MOTORCYCLE

(75) Inventor: Mitsuru Kowada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 893 days.

(21) Appl. No.: 12/218,188

(22) Filed: Jul. 11, 2008

(65) Prior Publication Data

US 2009/0020080 A1 Jan. 22, 2009

(30) Foreign Application Priority Data

Jul. 17, 2007 (JP) ..... 2007-186152

(51) Int. Cl.
*F01P 3/22* (2006.01)
*F01P 7/14* (2006.01)

(52) U.S. Cl. ..... 123/41.54; 123/41.1; 123/41.33; 123/196 AB

(58) Field of Classification Search ..... 123/41.1, 123/41.33, 196 AB, 41.54
See application file for complete search history.

(56) References Cited

U.S. PATENT DOCUMENTS

| | | | | |
|---|---|---|---|---|
| 2,799,260 | A * | 7/1957 | Butler | 123/41.54 |
| 3,981,279 | A * | 9/1976 | Bubniak et al. | 123/41.14 |
| 4,273,563 | A | 6/1981 | Fadda et al. | |
| 4,346,757 | A | 8/1982 | Cheong et al. | |
| 4,473,037 | A * | 9/1984 | Michassouridis et al. | 123/41.1 |
| 4,748,941 | A * | 6/1988 | Kashiwase | 123/41.1 |
| 4,790,369 | A | 12/1988 | Avrea | |
| 5,111,776 | A * | 5/1992 | Matsushiro et al. | 123/41.54 |
| 6,343,573 | B1 * | 2/2002 | Takahashi | 123/41.1 |
| 7,216,609 | B2 * | 5/2007 | Theorell | 123/41.31 |

FOREIGN PATENT DOCUMENTS

| | | |
|---|---|---|
| FR | 2 250 381 A5 | 5/1975 |
| FR | 2 408 722 A1 | 6/1979 |
| JP | 58-013120 | 1/1983 |
| JP | 59-201918 A | 11/1984 |
| JP | 2007-002678 | 1/2007 |

* cited by examiner

*Primary Examiner* — Noah Kamen
(74) *Attorney, Agent, or Firm* — Carrier Blackman & Associates, P.C.; William D. Blackman; Joseph P. Carrier

(57) ABSTRACT

A cooling system for a water-cooled internal combustion engine includes a coolant flow circuit and a coolant return passage. The coolant flow circuit includes a water pump, a water jacket having a plurality of serially connected flow passages, an oil cooler, a radiator, and a pressure-regulating valve for discharging coolant to a reservoir tank when pressure of the coolant in the coolant flow circuit reaches a predetermined target value. The coolant return passage supplies coolant from the reservoir tank to the coolant flow circuit via a check valve, which only allows coolant to flow in one direction from the reservoir tank to the coolant flow circuit.

20 Claims, 9 Drawing Sheets

COOLING SYSTEM FOR AN INTERNAL COMBUSTION ENGINE IN A MOTORCYCLE

CROSS-REFERENCE TO RELATED APPLICATIONS

The present application claims priority under 35 USC §119 based on Japanese patent application No. 2007-186152, filed on Jul. 17, 2007. The entire subject matter of this priority document is incorporated by reference herein.

BACKGROUND OF THE INVENTION

1. Field of the Invention

The present invention relates to a cooling system for a water-cooled internal combustion engine. More particularly, the present invention relates to a cooling system having a pressure-regulating valve and a coolant return passage for controlling pressure of coolant in the cooling system, and to an internal combustion engine and a motorcycle incorporating the described cooling system.

2. Description of the Background Art

There are several known cooling devices (cooling systems) for a water-cooled internal combustion engines. Such cooling devices include a radiator cap detachably provided for replenishing coolant to a coolant system, a pressure-regulating valve including a high-pressure valve and a low-pressure valve provided with the radiator cap for adjusting a pressure of coolant in the cooling system, and a reservoir tank fluidly connected with the radiator cap.

An example of such cooling device for a water-cooled internal combustion engine is disclosed in the Japanese Patent Document JP-A-2007-2678.

According to the cooling device for the water-cooled internal combustion engine, as disclosed in the Japanese Patent Document JP-A-2007-2678, when cooling-water pressure inside the cooling system becomes equal to or greater than a predetermined value, the high-pressure valve of the radiator cap is released and coolant from the cooling system is discharged into the reservoir tank. Hence, cooling-water pressure inside the cooling system is lowered so as to prevent the coolant pressure from being elevated to a predetermined value or more.

Further, when a temperature of coolant in the cooling system is lowered and the cooling-water pressure inside of the cooling system is lowered to a predetermined value or below the predetermined value, the lower pressure valve of the radiator cap is released. Hence, coolant inside the reservoir tank flows in the cooling system so as to possibly prevent the cooling-water pressure inside the cooling system from being lowered to the predetermined value or below the predetermined pressure.

With respect to the cooling device of the water-cooled internal combustion engine according to the Japanese Patent Document JP-A-2007-2678, when a vehicle is stopped for a long time in an idling state after performing a normal operation, the cooling ability of the radiator is largely lowered due to the absence of traveling wind.

Hence, due to absence of traveling wind, temperature of the coolant is elevated, and the coolant pressure inside the cooling system is also elevated. When pressure of coolant is elevated to a value greater than or equal to a predetermined value, the high-pressure valve of the radiator cap is released, and coolant is discharged from the radiator to the reservoir tank.

When the motorcycle is operated to travel thereafter, the radiator is sufficiently cooled by the traveling wind such that the temperature of coolant is lowered. When pressure of coolant inside the cooling system is lowered to a value less than or equal to a predetermined value, the low-pressure valve of the radiator cap is released, and coolant returns to the cooling device from the reservoir tank.

However, in the system as disclosed in the Japanese Patent Document JP-A-2007-2678, the radiator cap is arranged upstream of the radiator. Accordingly, even when a quantity of coolant inside the cooling system is decreased, coolant in the cooling system is not sufficiently replenished since coolant which flows upstream of the radiator is pressurized by the water pump.

Accordingly, the pressure of coolant which flows in the vicinity of the radiator cap is higher than the pressure of coolant disposed over (circulated through) the whole cooling system. Hence, it is difficult for coolant to return to the cooling device when the motorcycle is in a traveling state.

The present invention has been made to overcome such drawbacks as discussed above. Accordingly, it is one of the objects of the present invention to provide a cooling system for a water-cooled internal combustion engine which can rapidly return coolant to the engine as needed, even when a motorcycle is in a traveling state, thus enhancing the cooling performance of the cooling system.

SUMMARY OF THE INVENTION

In order to achieve above objects, the present invention according to a first aspect thereof provides a cooling device (cooling system) for a water-cooled internal combustion engine in which a coolant flow circuit of the internal combustion engine is formed of a water pump which discharges coolant, an internal combustion engine coolant flow passage which cools the internal combustion engine using the coolant, a radiator which cools the coolant, an oil cooler which cools a lubrication oil using the coolant, and a plurality of coolant flow passages which is communicably connected with each other for allowing the flow of coolant, a pressure-regulating valve is interposed in the coolant flow circuit.

The pressure-regulating valve supplies (or discharges) coolant when pressure of the coolant assumes a predetermined value. The pressure-regulating valve is fluidly connected with a reservoir tank which stores coolant received via a coolant overflow passage (also referred as an overflow tube).

In addition, the first aspect is characterized in that, a coolant return passage which supplies coolant to the coolant flow circuit from the reservoir tank is provided separate from the coolant overflow passage. The coolant return passage is connected with the coolant flow circuit via a check valve (a one-way valve) which allows coolant to flow only from the reservoir tank to the coolant flow circuit.

The present invention according to a second aspect thereof, in addition to the first aspect, is characterized in that the coolant flow circuit includes a main flow passage having a flow path (also referred as a flow passage).

During a normal operation of the engine, the flow path allows coolant after being discharged from the water pump return to the water pump after passing through a lubrication oil cooling passage and through a series of elements in an order, i.e., a water jacket of the internal combustion engine, a thermostat, the pressure-regulating valve and the radiator. In other words, the main flow passage includes a fluidly connected series network of a water jacket of the internal combustion engine, a thermostat, the pressure-regulating valve and the radiator.

The present invention according to the second aspect thereof is also characterized in that the coolant is branched after it is discharged from the water pump. The coolant passes through an oil cooler of the oil cooler and returns to the water pump.

The coolant return passage is connected with the lubrication oil cooling passage after passing the oil cooler, i.e., the coolant return passage is connected with the lubrication oil cooling passage at a downstream side of the oil cooler.

The present invention according to a third aspect thereof, in addition to one of the first and second aspects, is characterized in that, the check valve is arranged at a position below a coolant liquid level in the reservoir tank, and below a position where the coolant flow circuit and the coolant return passage are connected with each other.

The present invention according a fourth aspect thereof, in addition to one of the first through third aspects, is characterized in that a passage of the coolant return passage arranged closer to a reservoir tank side than a passage of the coolant return passage arranged closure to the check valve is made of a flexible material.

ADVANTAGE OF THE PRESENT INVENTION

When the vehicle having a water-cooled internal combustion engine mounted thereon is stopped and is in an idling state, or when an output of the internal combustion engine is largely increased in spite of a fact that a traveling speed of the vehicle is remarkably lowered due to the traveling of the vehicle on a steep ascending slope, the cooling ability of the radiator becomes insufficient. Hence, the temperature of coolant in the cooling system for the internal combustion engine is elevated whereby the coolant pressure inside the cooling system exceeds a predetermined pressure.

According to the present invention as described in the first aspect, when the coolant pressure inside the cooling system exceeds a predetermined value, the pressure-regulating valve is released, and a portion of coolant inside the cooling system is discharged to the reservoir tank so that the coolant pressure of the cooling system is held at a desirable predetermined pressure or at a pressure below the predetermined pressure.

Further, when the vehicle assumes a usual (normal) running state from an idling state or when the vehicle descends a slope for a long time after ascending a steep slope, the cooling ability of the radiator is increased or the output of the water-cooled internal combustion engine is lowered.

Hence, temperature of coolant in the cooling system is lowered whereby the pressure of coolant in the cooling system is lowered to a value equal to or less than the predetermined pressure. In such a case, the check valve arranged in the coolant return passage is released, and hence, coolant inside the reservoir tank flows into the coolant flow circuit via the coolant return passage.

In this manner, also during the traveling of the motorcycle, it is possible to speedily return coolant inside the coolant circulation system from the reservoir tank. Therefore, the cooling performance of the cooling system of the present invention can be enhanced.

According to the invention as described in the second aspect thereof, the coolant return passage is connected with the lubrication oil cooling passage in which coolant flows after passing the oil cooler where the pressure of coolant becomes lowest in the coolant system. In other words, the coolant return passage is connected with the lubrication oil cooling passage at a downstream side of the oil cooler. By making use of pressure difference, it is possible to more speedily return coolant inside the coolant circulation system from the reservoir tank. Therefore, the cooling performance of the cooling device can be further enhanced.

According to the invention ad described in the third aspect thereof, the check valve is arranged at a position below a coolant liquid level in the reservoir tank and below a position where the coolant flow circuit and the coolant return passage are connected with each other.

Accordingly, during filling coolant in the coolant flow circuit, it is possible to easily perform bleeding of air between the check valve and a position where the coolant flow circuit and the coolant return passage are connected with each other, and to easily fill coolant in the coolant flow circuit.

According to the invention as described in the fourth aspect thereof, a passage (a portion) of the coolant return passage arranged closer to a reservoir tank side than that is arranged at a check valve side is made of the flexible material. Accordingly, during filling coolant in the coolant flow circuit, it is possible to close the portion of the coolant return passage using a clip or the like to prevent inflow of air into the coolant flow circuit from the reservoir tank thus facilitating the filling of coolant in the cooling system.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

An illustrative embodiment of a cooling system for a water-cooled internal combustion engine, shown in FIG. 1 through FIG. 6, will now be described with reference to the drawings.

Figure 1:
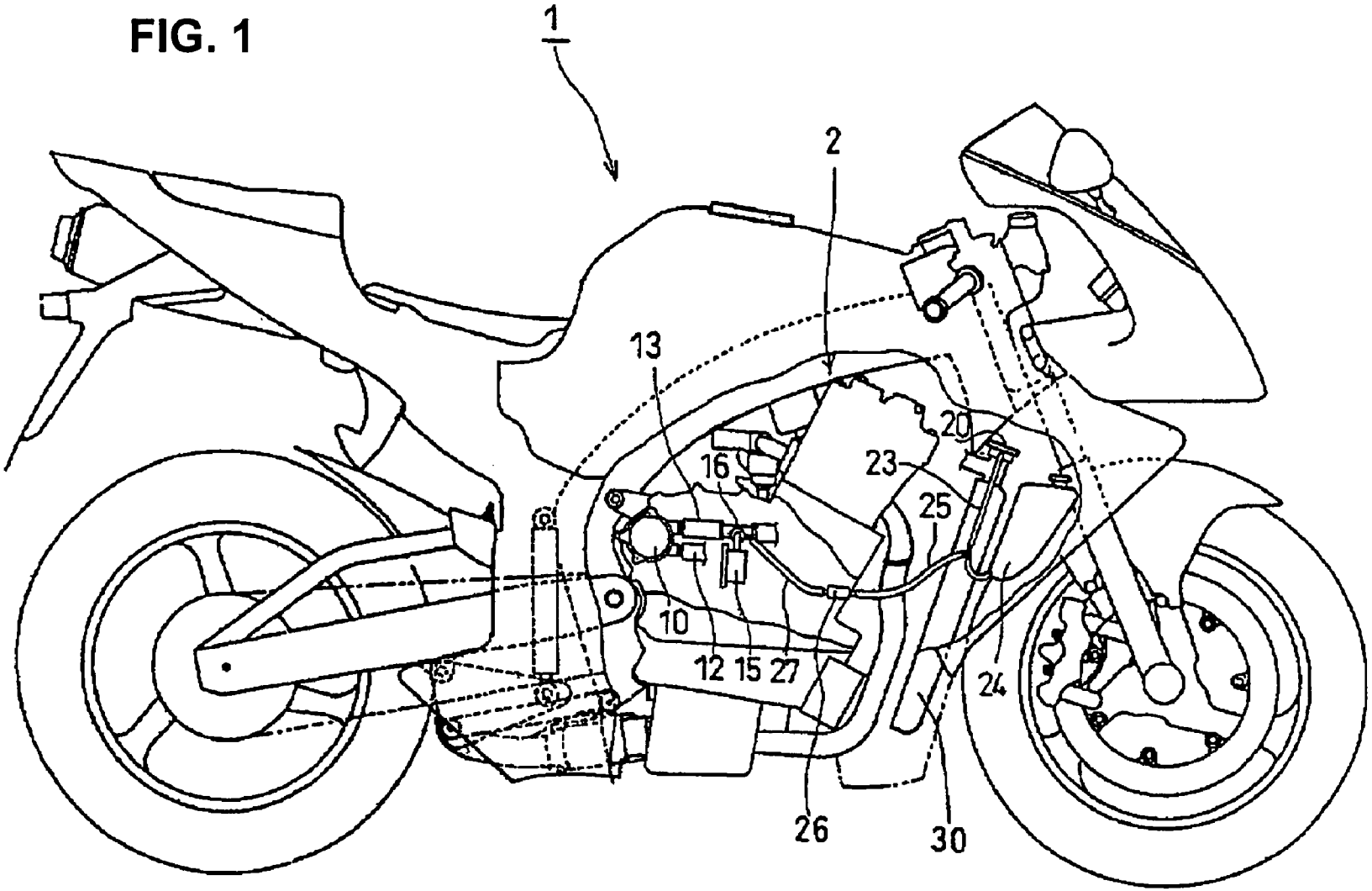
FIG. 1 is a side view of a motorcycle on which a water-cooled internal combustion engine including a cooling system according to the present invention is mounted.
Figure 2:
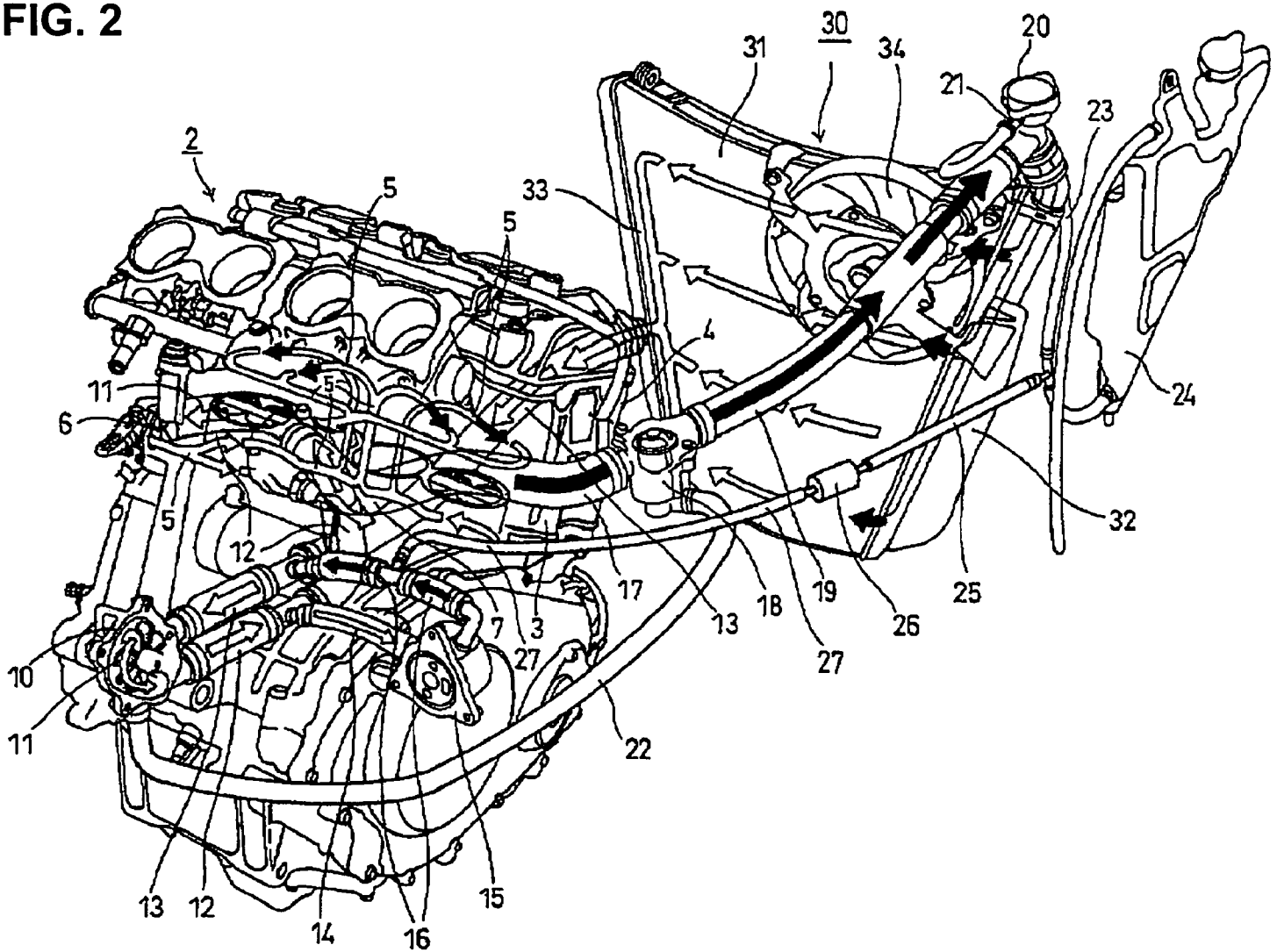
FIG. 2 is an enlarged perspective view of an essential part of the present invention shown in FIG. 1.

As shown in FIG. 1, a 4-cycle spark-ignition multi-cylinder in-line water-cooled internal combustion engine 2 is mounted on a substantially central portion of a vehicle body of a motorcycle 1. As shown in FIG. 2, in order to provide cooling to the internal combustion engine 2, a water jacket 5 is formed inside a cylinder block 3 and a cylinder head 4 of the engine 2. The water jacket 5 is made up of a plurality of interconnected flow passages formed in the cylinder block 3 and the cylinder head 4.

As shown in FIG. 2, a water pump 10 is arranged at a rear portion of the engine 2, and an impeller 11 of the water pump 10 is operatively connected with a crankshaft (not shown) of the water-cooled internal combustion engine 2.

When the impeller 11 of the water pump 10 is driven during operation of the engine 2, cooing water is supplied to the water jacket 5 of the engine 2 via a water pump discharge passage 12 and an engine coolant passage inlet 6.

Further, the water pump discharge passage 12 and a water pump intake passage 13 of the water pump 10 are connected with each other via an oil-cooler coolant inflow hose 14 (also referred as a lubrication oil cooling passage 14), an oil cooler 15 and an oil-cooler coolant outflow hose 16. A portion of coolant discharged from the water pump 10 passes through the oil-cooler coolant inflow hose 14, the oil cooler 15 and the oil-cooler coolant outflow hose 16, and thereafter, outflows to the water pump intake passage 13. Oil passing through the oil cooler 15 is cooled by coolant which passes through an internal heat exchanger therein.

Further, coolant flowing in through the engine coolant passage inlet 6 of the engine 2 is fed to the water jacket 5 which constitutes a plurality of respective coolant flow passages of the cylinder block 3 and the cylinder head 4 of the engine 2. The coolant flow passages may be interconnected with each other.

Thereafter, coolant is fed to a thermostat 18 from an engine coolant passage outlet 7 of the water jacket 5 via an engine coolant outflow hose 17.

Here, when a temperature of coolant, which passes the engine coolant outflow hose 17, has a value greater than or equal to a predetermined target temperature, coolant from the engine coolant outflow hose 17 is fed to a radiator 30 from the thermostat 18 via a radiator coolant inflow hose 19 and a radiator cap 20. In the radiator 30, the heat exchange is performed between coolant and air.

Further, the radiator 30 includes a radiator core 31, a vertically elongated upstream tank 32 and a vertically elongated downstream tank 33. The radiator core 31 includes a large number of tubes (not shown) arranged in a laterally horizontal direction and equidistantly spaced in a vertical direction. The radiator core 31 also includes a plurality of corrugated fins penetrating the tubes in the vertical direction and integrally joined to the tubes. The vertically elongated upstream tank 32 is connected with right ends of the respective tubes of the radiator core 31, and the vertically elongated downstream tank 33 is connected with left ends of the respective tubes of the radiator core 31.

A cooling fan 34 for blowing air to the radiator core 31 is arranged behind the radiator core 31 of the radiator 30.

Further, in the cooling system of the present invention, a vertically elongated reservoir tank 24 is arranged close to the upstream tank 32 on a right side, a pressure-regulating valve 21 is provided to the radiator cap 20, and an outlet of the pressure-regulating valve 21 is communicably connected with a bottom portion of the reservoir tank 24 via an overflow tube 23 (also referred as coolant overflow passage 23).

Further, a portion of the overflow tube 23 in the vicinity of the reservoir tank 24 and the oil-cooler coolant outflow hose 16 are communicably connected with each other using a reservoir tank side coolant recirculation tube 25 and a cooling-water-pump-side coolant recirculation tube 27 made of a flexible material such as a rubber material and a check valve 26.

The check valve is disposed between the reservoir tank side coolant recirculation tube 25 and cooling-water-pump-side coolant recirculation tube 27. Due to the provision of the check valve 26, coolant flows in only one direction from the reservoir tank side coolant recirculation tube 25 to the cooling-water-pump-side coolant recirculation tube 27.

Further, as shown in FIG. 1, the check valve 26 is arranged at a position below a coolant level inside the reservoir tank 24 as well as at a position below a position where the oil-cooler coolant outflow hose 16 and the water pump intake passage 13 are connected with each other.

The pressure-regulating valve 21 of the radiator cap 20 includes a high-pressure valve and a low-pressure valve. It may be noted that the low-pressure valve is optional, and it is not always necessary to provide the low-pressure valve. When the pressure of the cooling system (e.g., pressure of coolant in the inflow hose 19) is elevated to a value greater than or equal to a predetermined upper pressure value, the pressure-regulating valve 21 is released so that coolant flows into the reservoir tank 24 through the overflow tube 23 connected with the radiator cap 20.

On the other hand, when the pressure of the cooling system is lowered to a value less than or equal to a predetermined lower pressure value, coolant from the reservoir tank 24 flows into the water pump intake passage 13 via the overflow tube 23, the reservoir tank side coolant recirculation tube 25, the check valve 26, the cooling-water-pump-side coolant recirculation tube 27, and the oil-cooler coolant outflow hose 16. Accordingly, the cooling system is replenished with coolant, whereby the pressure of cooling system is adjusted to a desirable predetermined value or more.

The embodiment of the present invention as shown in FIG. 1 to FIG. 6 is constituted as described above.

Figure 3:
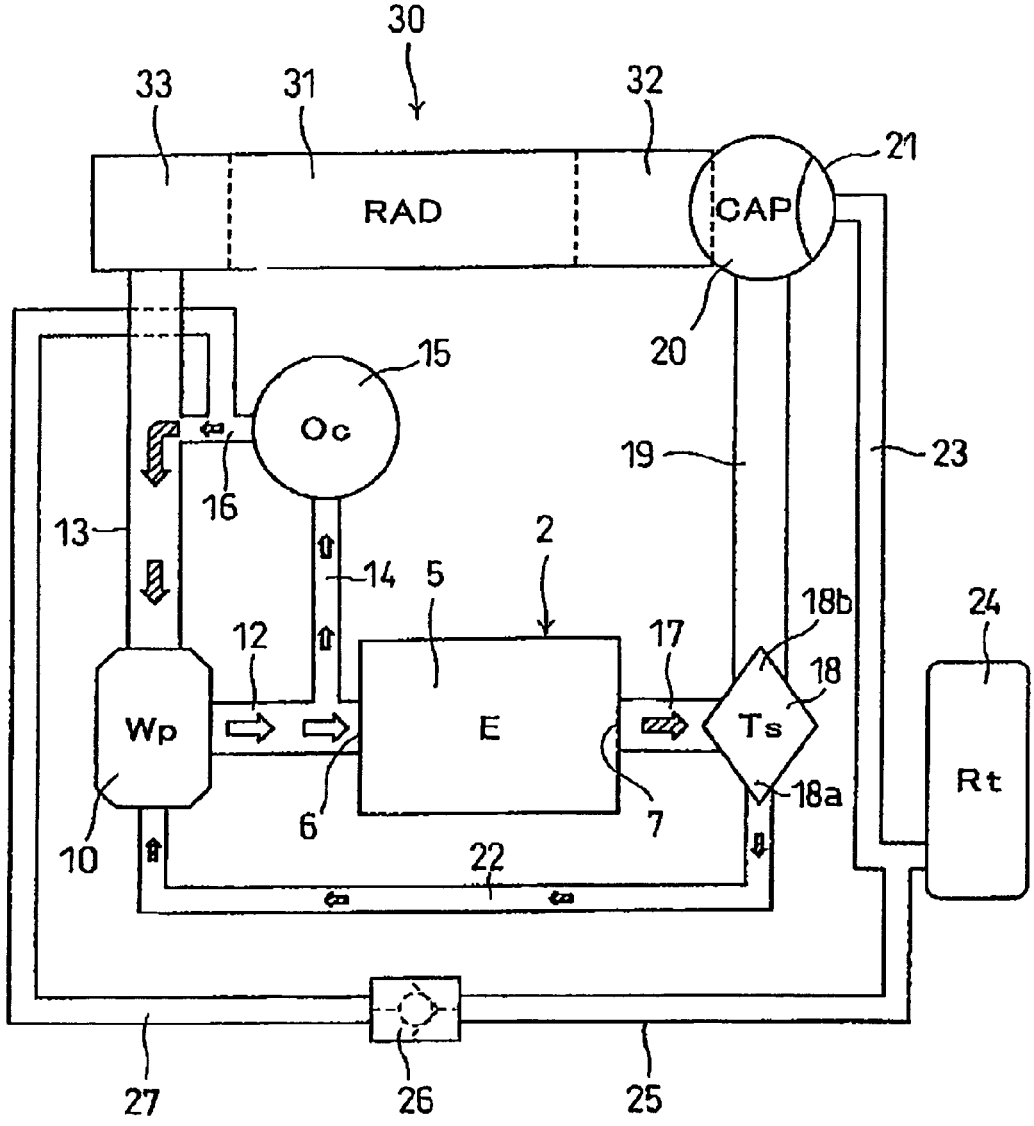
FIG. 3 is a view showing a flow path of coolant in a cooling-water circulation passage during warming up the water-cooled internal combustion engine.

Accordingly, immediately after the engine 2 is started and the coolant is not sufficiently warmed up, as shown in FIG. 3, a low-temperature outflow port 18*a* of the thermostat 18 is opened. The coolant which passes through the water jacket 5 of the engine 2 is not supplied to the radiator 30 and flows in the water pump 10 from the low-temperature outflow port 18*a* via a bypass hose 22, and is fed to the water jacket 5 of the engine 2. Accordingly, the engine 2 can be rapidly warmed up.

Figure 4:
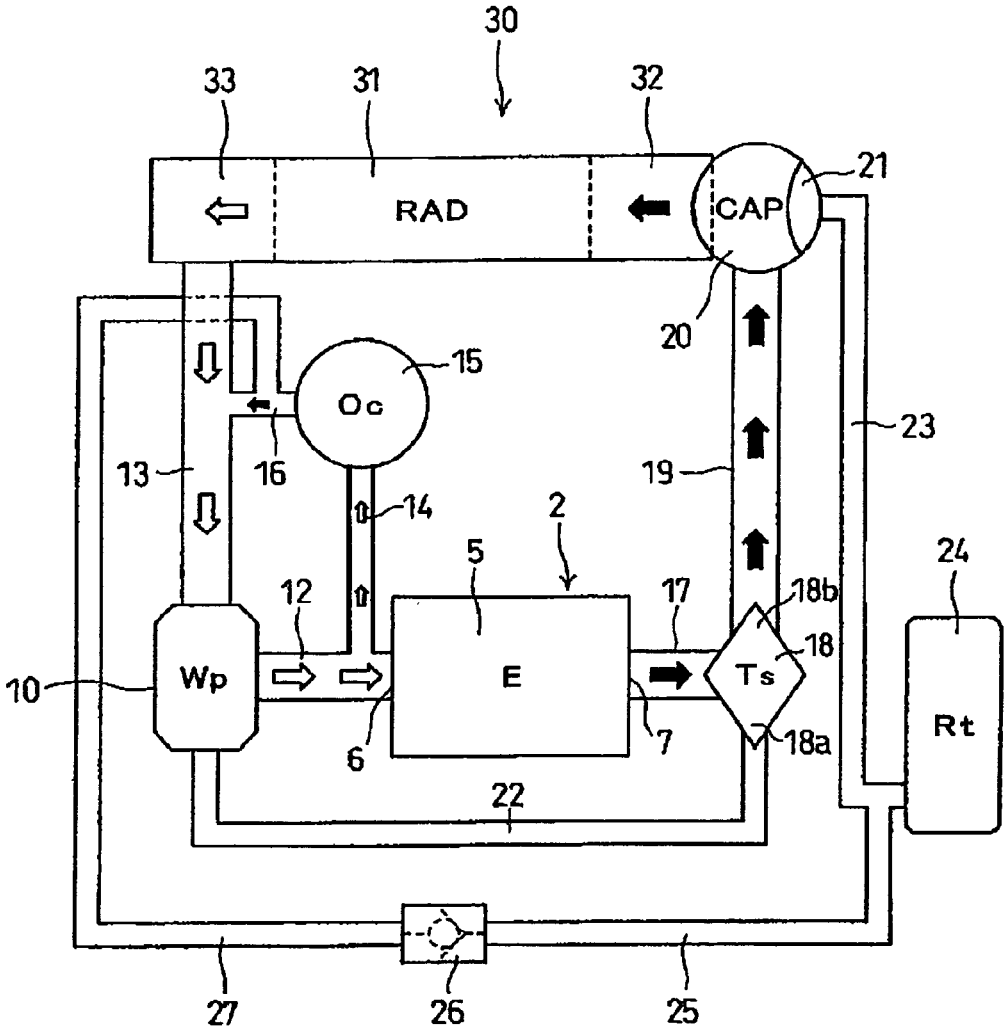
FIG. 4 is a view showing a flow path of coolant in the cooling-water circulation passage during a normal operation of the water-cooled internal combustion engine.

Further, as shown in FIG. 4, when the engine 2 is continuously driven so that the temperature of coolant is elevated to a temperature greater than or equal to a predetermined temperature, and when the thermostat 18 detects such high temperature of coolant, the low-temperature outflow port 18*a* of the thermostat 18 is closed and a high-temperature outflow port 18*b* of the thermostat 18 is opened.

When high-temperature outflow port 18*b* of the thermostat 18 is opened, the engine coolant outflow hose 17 and the radiator coolant inflow hose 19 are communicated with each other. Accordingly, coolant heated by the engine 2 flows in the radiator 30 via of the radiator cap 20. The radiator 30 cools the coolant.

When the motorcycle 1 is stopped for a long time in an idling state after performing a normal operation, a traveling wind does not pass through the core 31 of the radiator 30. In such situation, the radiator 30 is cooled by an air flow (cooling wind) generated only by the cooling fan 34. Accordingly, the cooling ability of the radiator 30 is lowered, and as a result, temperature of coolant is elevated.

Figure 5:
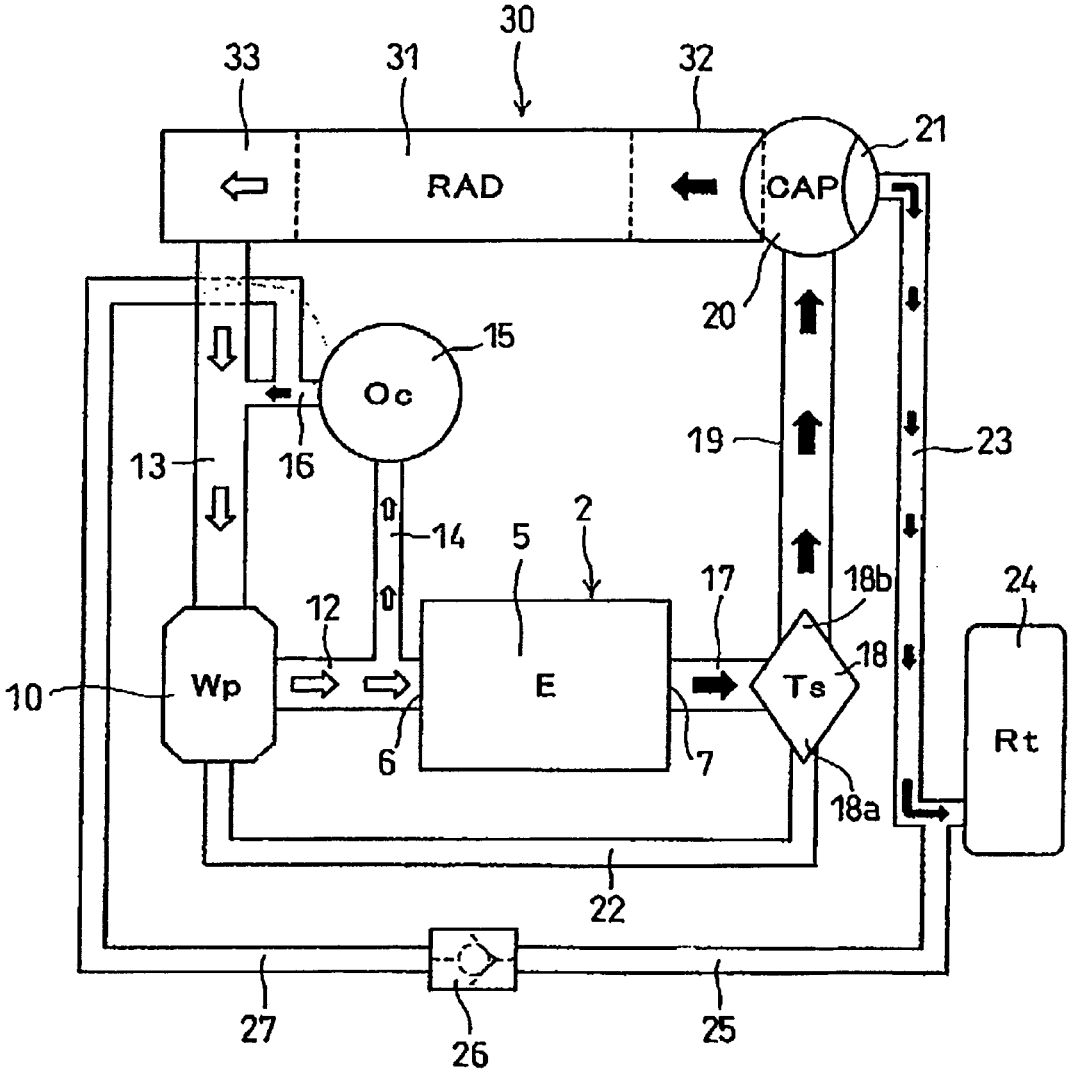
FIG. 5 is a view showing a flow path of coolant in the cooling-water circulation passage in a state when an internal pressure of the cooling system of the water-cooled internal combustion engine is elevated.

Then, when an internal pressure of the cooling system is elevated to a high pressure having a value greater than or equal to a predetermined value due to increase in temperature of the coolant, as shown in FIG. 5, the pressure-regulating valve 21 provided to the radiator cap 20 is released. Upon release of the pressure-regulating valve, coolant flows in the reservoir tank 24 via the overflow tube 23. Accordingly, it is possible to prevent the abnormal increase in pressure of coolant in the cooling system of the internal combustion engine 2.

Thereafter, when the motorcycle 1 is operated to move, i.e., starts traveling again, coolant is sufficiently cooled by traveling wind which passes through the radiator core 31 of the radiator 30 so that temperature of the coolant is lowered. Accordingly, coolant is condensed thus lowering pressure of the cooling-water inside the coolant system.

Figure 6:
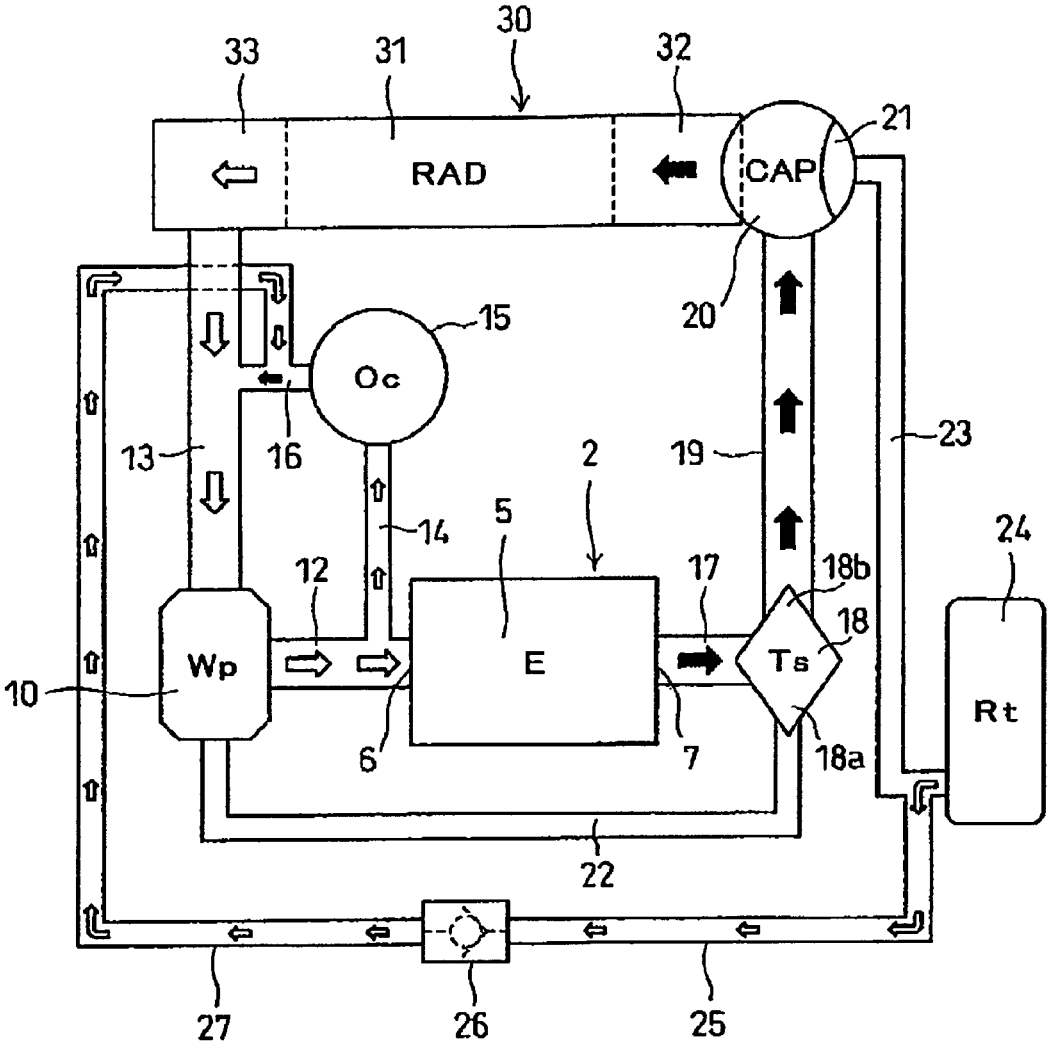
FIG. 6 is a view showing a flow path of coolant in the cooling-water circulation passage in a state when the internal pressure of the cooling system of the water-cooled internal combustion engine is lowered.

Here, as shown in FIG. 6, the oil-cooler coolant outflow hose 16 is connected with a downstream side of the water pump 10 via the water pump intake passage 13. Accordingly, pressure of the cooling-water inside the oil-cooler coolant outflow hose 16 is particularly lowered.

Accordingly, when the difference in pressure between coolant inside the reservoir tank 24 and coolant inside the oil-cooler coolant outflow hose 16 is increased, the check valve 26 is opened so that coolant from the reservoir tank 24 flows to the water pump 10 via the overflow tube 23, the reservoir tank side coolant recirculation tube 25, the check valve 26, the cooling-water-pump-side coolant recirculation tube 27, the oil-cooler coolant outflow hose 16 and the water pump intake passage 13. In this manner, the cooling system of the motorcycle 1 is replenished with coolant. Therefore, it is possible to return coolant to the coolant system efficiently.

Accordingly, due to the difference in pressure between coolant inside the reservoir tank 24 and coolant inside the oil-cooler coolant outflow hose 16, it is possible to smoothly return coolant to the cooling system and hence, the cooling performance of the cooling device can be enhanced.

Further, the check valve 26 is arranged at a position below a coolant level inside the reservoir tank 24 and at a position below a position where the oil-cooler coolant outflow hose 16 and the water pump intake passage 13 are connected with each other. Therefore, it is possible to easily replenish coolant into the cooling device without leaving air inside the cooling-water-pump-side coolant recirculation tube 2 by filling coolant in the cooling system.

Further, the reservoir tank side coolant recirculation tube 25 and the cooling-water-pump-side coolant recirculation tube 27 are made of the flexible material such as a rubber material. Therefore, during filling coolant in the cooling system, it is possible to close the reservoir tank side coolant recirculation tube 25 using a clip or the like. Since it is possible to prevent bleeding of air into the reservoir tank side coolant recirculation tube 25 from a reservoir tank 24 side, the cooling system can be easily replenished with coolant.

Figure 7:
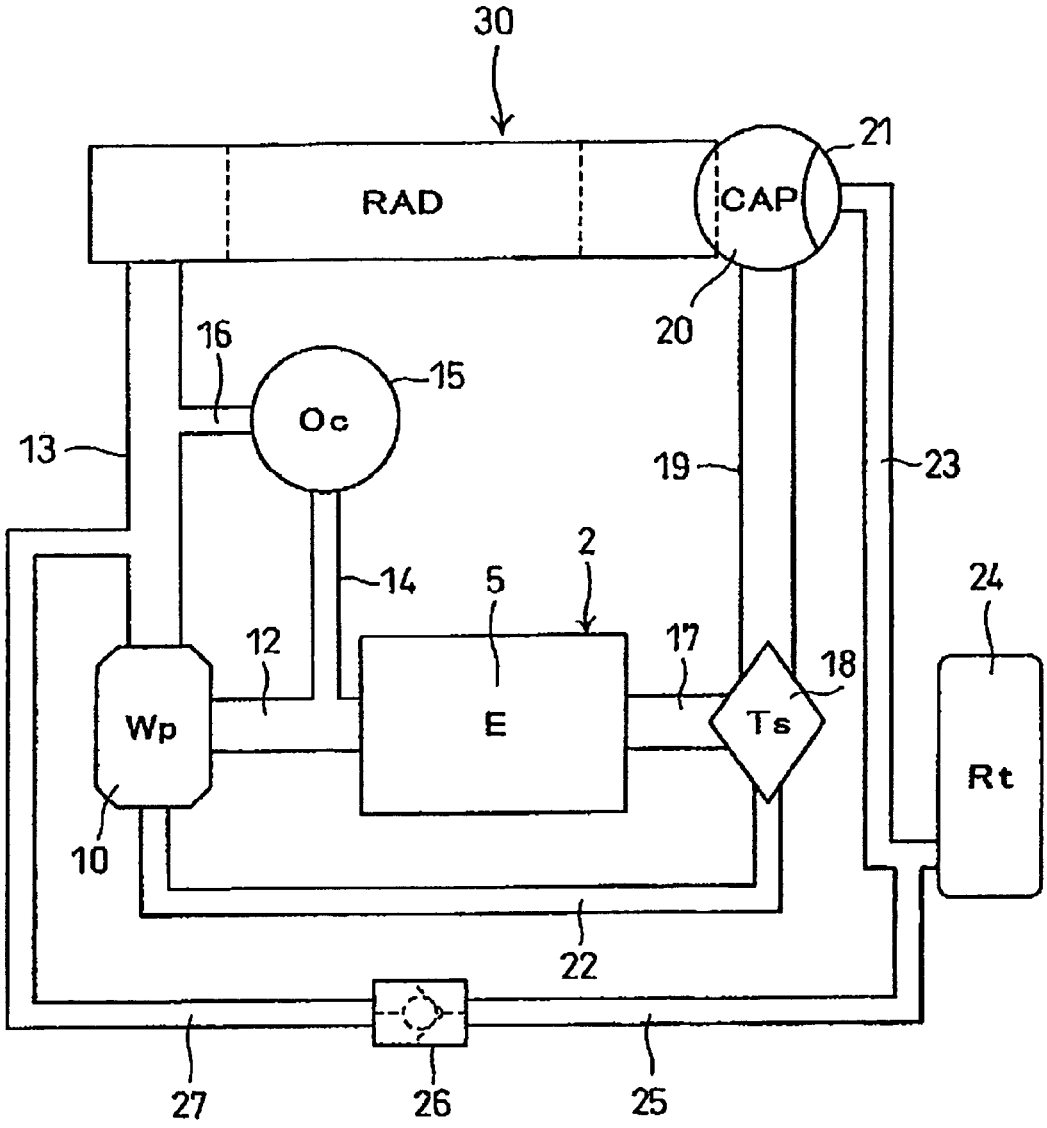
FIG. 7 is a view showing a cooling-water circulation passage in a second embodiment.

In the embodiment explained in conjunction with FIG. 1 to FIG. 6, one end of the cooling-water-pump-side coolant recirculation tube 27 is connected with the oil-cooler coolant outflow hose 16. However, in an embodiment of the present invention, as shown in FIG. 7, one end of the cooling-water-pump-side coolant recirculation tube 27 may be directly connected with the water pump intake passage 13.

Figure 8:
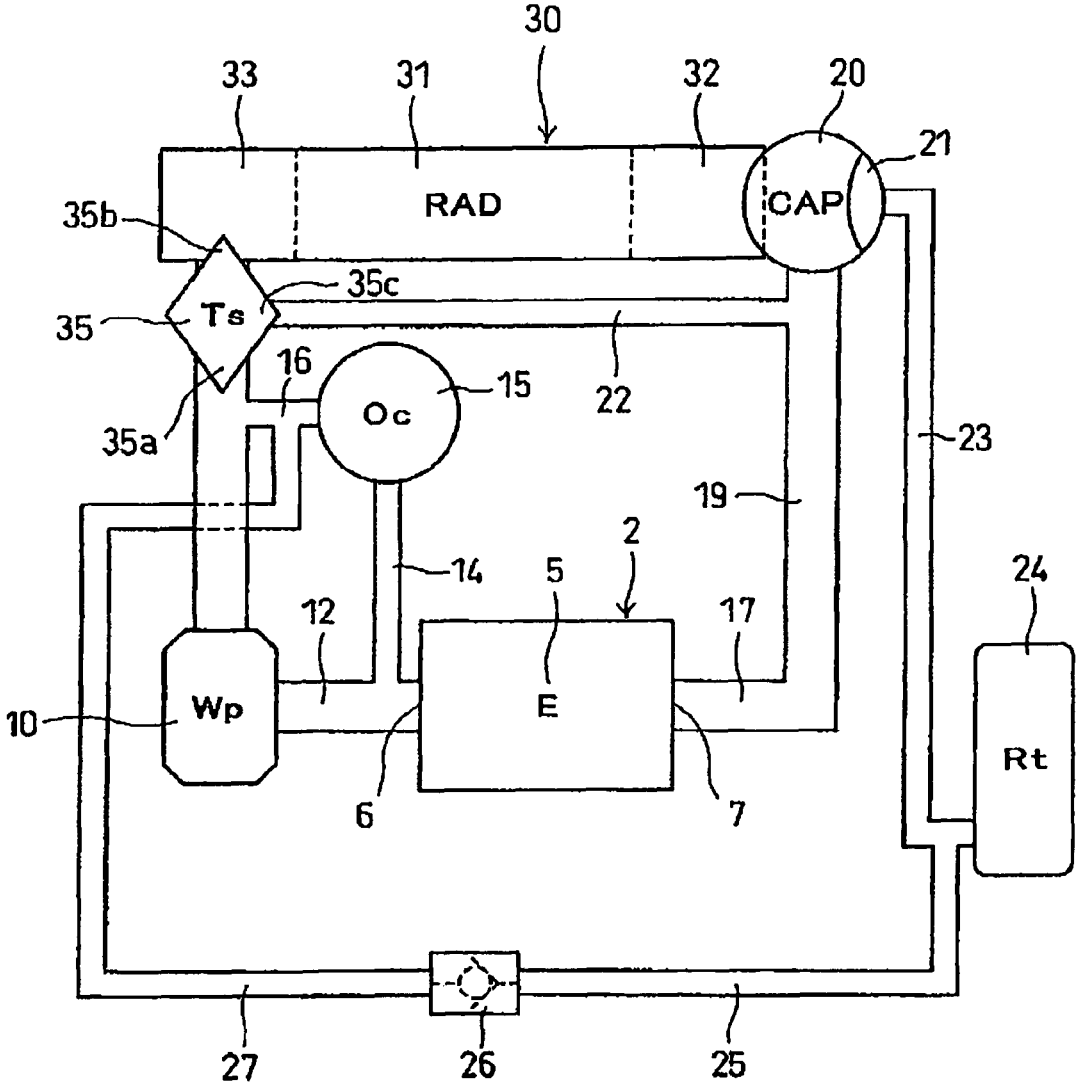
FIG. 8 is a view showing a cooling-water circulation passage in a third embodiment.

Further, in another embodiment, as shown in FIG. 8, a thermostat 35 is arranged between a downstream tank 33 of a radiator 30 and a water pump 10. The thermostat 35 includes an outflow port 35*a*, a high-temperature inflow port 35*b* which is communicably connected with the outflow port 35*a* when coolant assumes a high temperature, and a low-temperature inflow port 35*c* which is communicably connected with the outflow port 35*a* when coolant assumes a low temperature.

The high-temperature inflow port 35*b* of the thermostat 35 may be connected with the downstream tank 33, and one end of the bypass hose 22 may be connected with the low-temperature inflow port 35*c* of the thermostat 35. At the same time, another end of the bypass hose 22 may be connected with an intermediate portion of the radiator coolant inflow hose 19, and the outflow port 35*a* of the thermostat 35 may be connected with the water pump intake passage 13 of the water pump 10.

Accordingly, in the embodiment as shown in FIG. 8, when coolant is not sufficiently warmed up, the low-temperature inflow port 35*c* and the outflow port 35*a* are communicably connected with each other due to the thermostat 35, and coolant flows in the bypass hose 22 without passing through the radiator 30 so as to rapidly warm up the engine 2.

When the engine 2 is continuously operated and coolant is sufficiently warmed up, the high-temperature inflow port 35*b* and the outflow port 35*a* are communicably connected with each other such that coolant passes through radiator 30 without passing through the bypass hose 22. The coolant is cooled in the radiator.

Figure 9:
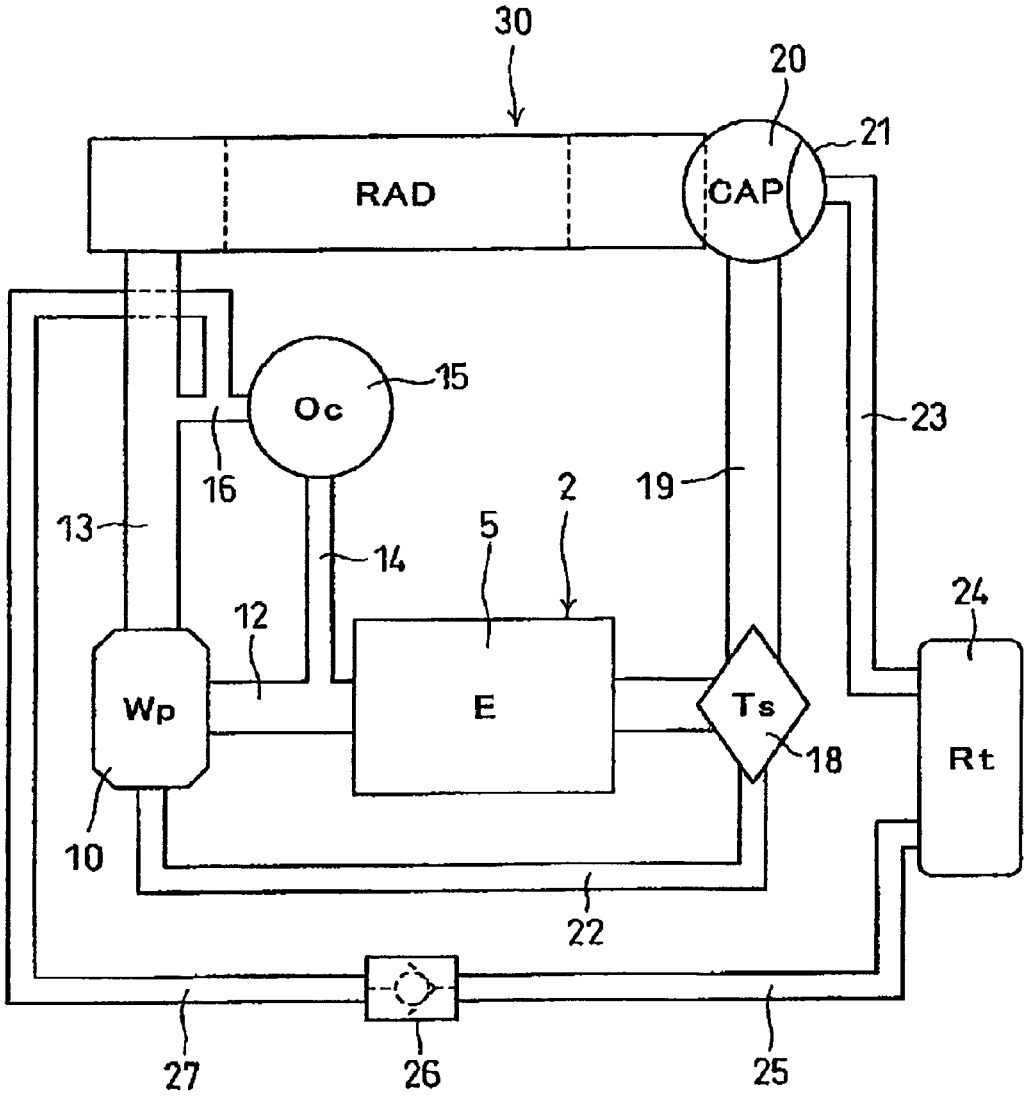
FIG. 9 is a view showing a cooling-water circulation passage in a fourth embodiment.

Further, in the embodiment explained in conjunction with FIG. 1 to FIG. 6, the reservoir tank side coolant recirculation tube 25 is branched from the overflow tube 23. However in an embodiment of the present invention, as shown in FIG. 9, the reservoir tank side coolant recirculation tube 25 may be directly connected with the reservoir tank 24.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. In a water-cooled internal combustion engine of the type including a coolant flow circuit for circulating coolant used to cool the internal combustion engine, said coolant flow circuit including a water jacket formed in the internal combustion engine and comprising a plurality of coolant flow passages which are communicably connected with each other for allowing flow of the coolant, a water pump for discharging coolant to the water jacket for cooling the internal combustion engine using the coolant, a radiator which cools the coolant, an oil cooler for cooling a lubrication oil using the coolant received from the water pump, a coolant overflow passage operatively connected with the coolant flow circuit, a reservoir tank operatively connected with said coolant overflow passage, the reservoir tank arranged to store the coolant received via the coolant overflow passage, and a pressure regulating valve interposed in the coolant flow circuit and operatively connected with the reservoir tank via said coolant overflow passage, wherein said pressure regulating valve discharges the coolant from the coolant flow circuit to the reservoir tank via the coolant overflow passage when pressure of the coolant in the coolant flow circuit reaches a predetermined value;

the improvement comprising a coolant return passage for supplying coolant to the coolant flow circuit from the reservoir tank, said coolant return passage having a check valve interposed therein, wherein said coolant return passage is branched off from the coolant overflow passage; and wherein said coolant return passage is connected with the coolant flow circuit such that the coolant flows in one direction via said check valve from the reservoir tank to the coolant flow circuit.

2. A water-cooled internal combustion engine according to claim 1, wherein:

the coolant flow circuit includes a main flow passage formed of a flow path;

during normal operation of the engine, the flow path allows coolant, after being discharged from a water pump return to the water pump after passing through the cooling portion of the internal combustion engine, a thermostat, the pressure regulating valve and the radiator in such an order, and a lubrication oil cooling passage;

further, during normal operation of the engine, coolant discharged from the water pump is branched such that a portion of the branched coolant passes through the oil cooler and returns to the water pump; and the coolant return passage is connected with the lubrication oil cooling passage at a downstream side of the oil cooler.

3. A water-cooled internal combustion engine according to claim 2, wherein said check valve is arranged at a position below a coolant liquid level in the reservoir tank and at a position below where the coolant flow circuit and the coolant return passage are connected with each other.

4. A water-cooled internal combustion engine according to claim 2, wherein the coolant return passage includes a reservoir tank side passage having a portion thereof, which is arranged closer to a reservoir tank side than a check valve side, made of a flexible material.

5. A water-cooled internal combustion engine according to claim 1, wherein said check valve is arranged at a position below a coolant level in the reservoir tank, and at a position below where the coolant flow circuit and the coolant return passage are connected with each other.

6. A water-cooled internal combustion engine according to claim 5, wherein the coolant return passage includes a reservoir tank side passage having a portion thereof, which is arranged closer to a reservoir tank side than a check valve side, made of a flexible material.

7. A water-cooled internal combustion engine according to claim 1, wherein the coolant return passage includes a reservoir tank side passage having a portion thereof, which is arranged closer to a reservoir tank side than a check valve side, made of a flexible material.

8. An internal combustion engine having a cooling system, said internal combustion engine comprising a coolant flow circuit for providing cooling to the internal combustion engine and an oil cooler; and a coolant return passage operatively connected with the coolant flow circuit;

wherein said coolant flow circuit is formed of:

a water jacket formed in a cylinder block and a cylinder head of the engine;

an oil cooler which cools a lubrication oil using the coolant received from the water pump;

a water pump for discharging coolant to the water jacket and the oil cooler;

a radiator which cools the coolant;

a plurality of coolant flow passages which are communicably connected with each other for allowing the flow of coolant;

a coolant discharge passage operatively connected with one of said plurality of passages;

a reservoir tank fluidly connected with said one of said plurality of flow passages via said coolant discharge passage; the reservoir tank operable to store the coolant received via the coolant overflow passage;

a pressure regulating valve interposed in said one of said plurality of the passages and operatively connected with the reservoir tank, said pressure regulating valve discharges the coolant from said one of said plurality of coolant flow passages to the reservoir tank via a coolant discharge passage when pressure of the coolant in said one of said plurality of passages is greater than or equal to a predetermined value; and wherein said coolant return passage comprises a check valve interposed in said coolant return passage; and wherein said coolant return passage is branched off from the coolant discharge passage; and wherein said coolant return passage is connected with one of said plurality of passages of the coolant flow circuit such that the coolant flows in one direction via said check valve from the reservoir tank to the coolant flow circuit.

9. An internal combustion engine according to claim 8, wherein the coolant flow circuit includes a flow path;

during normal operation of the engine, the flow path allows coolant, after being discharged from the water pump, return to the water pump after passing through the cooling portion of the interns combustion engine, a thermostat, the pressure regulating valve and the radiator in such an order, and a lubrication oil cooling passage;

further, during normal operation of the engine, coolant discharged from the water pump is branched such that the branched coolant passes through the oil cooler and returns to the water pump via said lubrication oil cooling passage; and the coolant return passage is connected with the lubrication oil cooling passage at a downstream side of the oil cooler.

10. An internal combustion engine according to claim 9, wherein said check valve is arranged at a position below a coolant level in the reservoir tank and at a position below where the coolant flow circuit and the coolant return passage are connected with each other.

11. An internal combustion engine according to claim 9, wherein the coolant return passage includes a reservoir tank side passage having a portion thereof, which is arranged closer to a reservoir tank side than a check valve side, made of a flexible material.

12. An internal combustion engine according to claim 8, wherein said check valve is arranged at a position below a coolant liquid level in the reservoir tank and at a position below where the coolant flow circuit and the coolant return passage are connected with each other.

13. An internal combustion engine according to claim 12, wherein the coolant return passage includes a reservoir tank side passage having a portion thereof, which is arranged closer to a reservoir tank side than a check valve side, made of a flexible material.

14. An internal combustion engine according to claim 8, wherein the coolant return passage includes a reservoir tank side passage having a portion thereof, which is arranged closer to a reservoir tank side than a check valve side, made of a flexible material.

15. A motorcycle comprising an internal combustion engine having a plurality of interconnected cooling portions formed therein;

an oil cooler having a cooling portion formed therein; and a cooling system for cooling the internal combustion engine and the oil cooler during operation thereof;

wherein said cooling system comprises a water pump fluidly connected, via a discharge passage thereof, with said plurality of interconnected cooling portions of the internal combustion engine and said cooling portion of the oil cooler;

a radiator fluidly connected with an intake passage of said water pump;

said radiator, during operation thereof, being operable to perform heat exchange between air, and coolant received from the plurality of cooling portions via an outflow hose of the engine, a radiator inflow hose and a radiator cap;

a pressure regulating valve provided with said radiator cap;

a reservoir tank fluidly connected with said pressure regulating valve via an overflow tube;

a coolant return passage fluidly connecting said reservoir tank with said intake passage of said water pump; and a one-way check valve disposed in the coolant return passage;

wherein:

said pressure regulating valve discharges a portion of coolant to the reservoir tank via said overflow tube when pressure of the coolant in the radiator inflow hose reaches a predetermined value;

when said coolant return passage supplies coolant from the reservoir tank to the intake passage of said water pump depending on a pressure difference between coolant in said intake passage of said water pump and coolant in said reservoir tank; and said coolant return passage is branched off from the overflow tube.

16. A motorcycle according to claim 15, wherein said one-way check valve allows coolant to flow in one direction from the reservoir tank to the intake passage of said water pump.

17. A motorcycle according to claim 15, wherein said check valve is arranged at a position below a coolant level in the reservoir tank and at a position below where the coolant return passage is connected with the intake passage of the water pump.

18. A motorcycle according to claim 15, wherein the radiator comprises a downstream tank and an upstream tank; and wherein the cooling system further comprises a thermostat disposed between the downstream tank and the intake passage of the water pump.

19. A motorcycle according to claim 15, wherein said coolant return passage comprises a water pump side passage and a reservoir tank side passage; and wherein at least one of said water pump side passage and said reservoir tank side passage reservoir tank side passage is made of a flexible material.

20. A motorcycle according to claim 19, wherein one end of said water pump side passage is directly connected with the intake passage of said water pump.

* * * * *